US007020918B1

(12) United States Patent
Tinsley

(10) Patent No.: US 7,020,918 B1
(45) Date of Patent: Apr. 4, 2006

(54) CUSHION SET FOR POSITIONING A HUMAN BODY

(76) Inventor: Ronald E. Tinsley, 2944 Adams St., Eugene, OR (US) 97405

( * ) Notice: Subject to any disclaimer, the term of this patent is extended or adjusted under 35 U.S.C. 154(b) by 0 days.

(21) Appl. No.: 11/080,084

(22) Filed: Mar. 14, 2005

(51) Int. Cl.
*A47C 16/00* (2006.01)

(52) U.S. Cl. ..... 5/632; 5/630; 5/638; 5/725; 5/731; 5/652; 5/657

(58) Field of Classification Search ..... 5/630, 5/632, 638, 620, 731, 733–735, 725, 652, 5/657, 900.5, 922
See application file for complete search history.

(56) References Cited

U.S. PATENT DOCUMENTS 4,802,249 A * 2/1989 Bills ..... 5/420
4,987,625 A * 1/1991 Edelson ..... 5/657
5,054,142 A 10/1991 Owens
5,400,449 A * 3/1995 Satto ..... 5/631
5,448,790 A * 9/1995 Saro et al. ..... 5/657
5,632,050 A * 5/1997 Zajas et al. ..... 5/632
5,893,183 A * 4/1999 Bechtold, Jr. ..... 5/632
5,987,675 A * 11/1999 Kim ..... 5/632
6,154,903 A * 12/2000 Wai-Chung ..... 5/632
6,185,768 B1 * 2/2001 Schlechter ..... 5/632
6,823,545 B1 * 11/2004 Davis ..... 5/630

* cited by examiner

*Primary Examiner*—Michael Trettel
(74) *Attorney, Agent, or Firm*—Robert E. Howard

(57) ABSTRACT

A cushion set for positioning a human body, including a face support cushion, a spacer block cushion, an upper torso support cushion, a lower torso support cushion, a calf support cushion and a bolster. The face support cushion is generally in the shape of an inverted "U" having a generally inverted U-shaped opening passing therethrough. The upper torso support cushion is adapted to be releasably attached to the face support cushion, the lower torso support cushion is adapted to be releasably attached to the upper torso support cushion, the calf support cushion is adapted to be releasably attached to the lower torso support cushion, and the bolster is adapted to be releasably attached to the calf support cushion. The spacer block cushion is adapted to be releasably attached to the underside of the face support cushion.

7 Claims, 2 Drawing Sheets

CUSHION SET FOR POSITIONING A HUMAN BODY

BACKGROUND OF THE INVENTION

The present invention relates to a cushion set for positioning the human body.

It is desirable to position the human body for performing massage or medical techniques. Various proposals have been made for devices to position the human body. Some involve a table or adjustable bed whose upper surface can be adjusted to different elevations to support variously the head, mid-body portion, hip areas, and/or calves. Most of these devices do not provide contoured support for the various body portions.

U.S. Pat. No. 5,054,142 describes a multi-component contoured body cushion having cushions for supporting the head, chest portion and abdomen. An ankle bolster cushion may also be used. The cushions are freely movable independent of each other. The cushions have curved contours, and the chest supporting cushion is formed of multiple layers of preformed sheets, all of which make the device expensive to fabricate.

SUMMARY OF THE INVENTION

It is an object of the present invention to provide a cushion set for supporting a human body which is relatively inexpensive to fabricate.

The cushion set includes a face support cushion, a spacer block cushion, an upper torso support cushion, a lower torso support cushion, a calf support cushion, and a bolster.

The face support cushion has an outer periphery generally in the shape of an inverted "U" having a generally inverted U-shaped opening passing therethrough.

The spacer block cushion is adapted to be releasably attached to the underside of the face support cushion.

The upper torso cushion is adapted to be releasably attached to the face support cushion in a manner that allows the distance between them to be varied. The upper torso cushion has an upper end, a lower end, and right and left sides, and has a longitudinal axis extending between the upper and lower ends in a mid-portion thereof. The upper torso cushion is substantially rectangular in cross-section in a plane passing perpendicularly therethrough along the longitudinal axis;

The lower torso cushion is adapted to be releasably attached to the lower end of the upper torso cushion in a manner that allows the distance between them to be varied. The lower torso cushion has an upper end, a lower end, and right and left sides, and has a longitudinal axis extending between the upper and lower ends in a mid-portion thereof. The upper torso cushion is substantially triangular in cross-section in a plane passing perpendicularly therethrough along the longitudinal axis, the base of the triangle being the upper end of the lower torso support cushion.

The calf support cushion is adapted to be releasably attached to the lower end of the lower torso cushion in a manner that allows the distance between them to be varied. The calf support cushion has an upper end, a lower end, and right and left sides, and has a longitudinal axis extending between said upper and lower ends in a mid-portion thereof. The calf cushion is substantially triangular in cross-section in a plane passing perpendicularly therethrough along the longitudinal axis, the base of the triangle being the lower end of the calf support cushion.

The bolster support cushion is adapted to be releasably attached to the lower end the calf support cushion in a manner that allows the distance between them to be varied.

DESCRIPTION OF PREFERRED EMBODIMENTS

Figure 1:
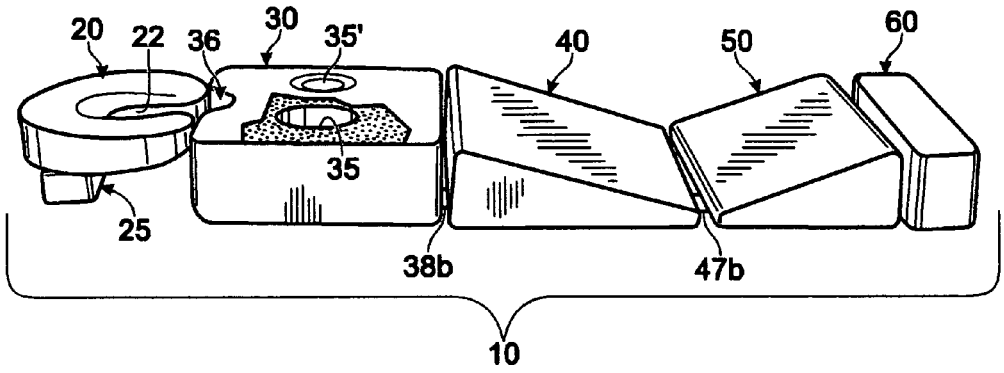
FIG. 1 is left side perspective view of the cushion set of the present invention.

The cushion set 10 of the present invention includes a face support cushion 20, an upper torso support cushion 30, a lower torso support cushion 40, a calf support cushion 50 and a bolster 60.

Figure 2:
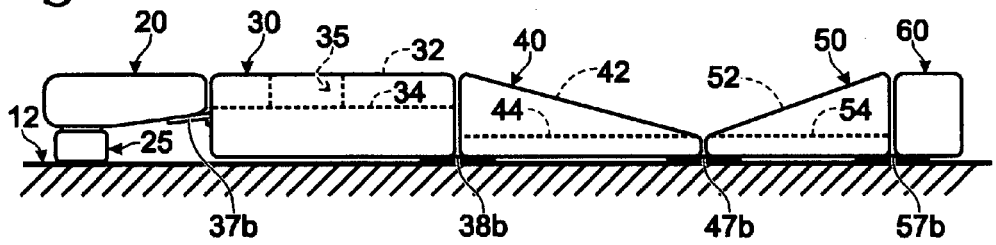
FIG. 2 is a left side elevational view of the cushion set shown resting upon a supporting surface.

The face support cushion 20 is located in the "upper" portion of cushion set 10, and the bolster 60 is located in the "lower" portion of cushion set 10. Thus, whenever the term "upper" is used, it is intended to refer to that portion of a support cushion facing towards face support cushion 20, and whenever the term "lower" is used, it is intended to refer to that portion of a support cushion facing towards bolster 60. The "longitudinal axis" of the support cushion set 10 is that imaginary line extending from face support cushion 20 through bolster 60 in the mid-portions thereof when cushion set 10 is assembled in its operable mode shown in FIGS. 1 and 2.

Face support cushion 20 is in the shape of an inverted "U" having an inverted U-shaped opening 22 therein for accommodating the eyes, nose and mouth of a user when the user is lying in a face down position on cushion set 10. Face support cushion 20 is formed from a foam sheet and covered with vinyl or a similar washable covering.

A spacer block cushion 25 can be positioned beneath face support 20 to make the upper surface thereof lie substantially in the same plane as the upper surface of upper torso support 30. Spacer block cushion 25 is formed of a foam block covered with vinyl or a similar washable covering.

Upper torso support cushion 30 has upper and lower surfaces that are generally rectangular in shape, and is comprised of upper and lower foam sheet cushions 32 and 34, respectively. Upper foam sheet cushion 32 includes left and right breast receiving openings 35 and 35', respectively. The upper end of torso support cushion 30 has a cutout 36 adapted to receive a lower portion of a user's face. Upper torso support cushion 30 is rectangular in cross-section along an imaginary plane passing perpendicularly through the upper and lower surfaces thereof between its upper and lower ends along the longitudinal axis thereof. The upper and lower foam sheet cushions 32 and 34 of upper torso support cushion 30 are covered with vinyl or a similar washable covering.

Lower torso support cushion 40 has upper and lower surfaces that are generally rectangular in shape, and is comprised of upper and lower foam sheet cushions 42 and 44, respectively. Upper foam sheet cushion 42 is triangular in cross-section along an imaginary plane passing perpendicularly through the upper and lower surfaces thereof between its upper and lower ends along the longitudinal axis thereof. The overall height of the upper end of lower torso support cushion 40 is substantially the same height as the overall height of the lower end of the upper torso support cushion 30. The upper and lower foam sheet cushions 42 and 44 of lower torso support cushion 40 are covered with vinyl or a similar washable covering.

Calf support cushion 50 is comprised of upper and lower foam sheet cushions 52 and 54, respectively. Upper foam sheet cushion 52 is triangular in cross-section along an imaginary plane passing perpendicularly through the upper and lower surfaces thereof between its upper and lower ends along the longitudinal axis thereof. The overall height of the lower end of calf support cushion 50 is substantially the same height as the overall height of the upper end of lower torso support cushion 40. The upper and lower foam sheet cushions 52 and 54 of calf support cushion 50 are covered with vinyl or a similar washable covering.

Bolster support cushion 60 is substantially rectangular in cross-section along an imaginary plane passing perpendicularly through the upper and lower surfaces thereof between its upper and lower ends along the longitudinal axis thereof. The height of bolster support cushion 60 is substantially the same height as the overall height of the lower end of calf support cushion 50. Bolster support cushion 60 is formed of a foam block covered with vinyl or a similar washable covering.

Support cushions 30, 40, 50 and 60 have substantially the same width and the right and left sides thereof are in substantial alignment during use. The overall height of upper torso support cushion 30 and bolster 60, as well as the overall height of the upper end of lower torso support cushion 40 and the overall height of the lower end of calf support cushion 50, are substantially identical.

The various support cushions 20, 25, 30, 40, 50 and 60 comprising cushion set 10 are removably connectable to each other, and the distance between them can be varied, by means of hook and loop fastener means, such as those sold under the trademark "VELCRO". Herein, one component of a hook and loop fastener means will be referred to as "hook or loop fastener component", while the adjacent mating component will be referred to as "loop or hook fastener component".

Figure 3:
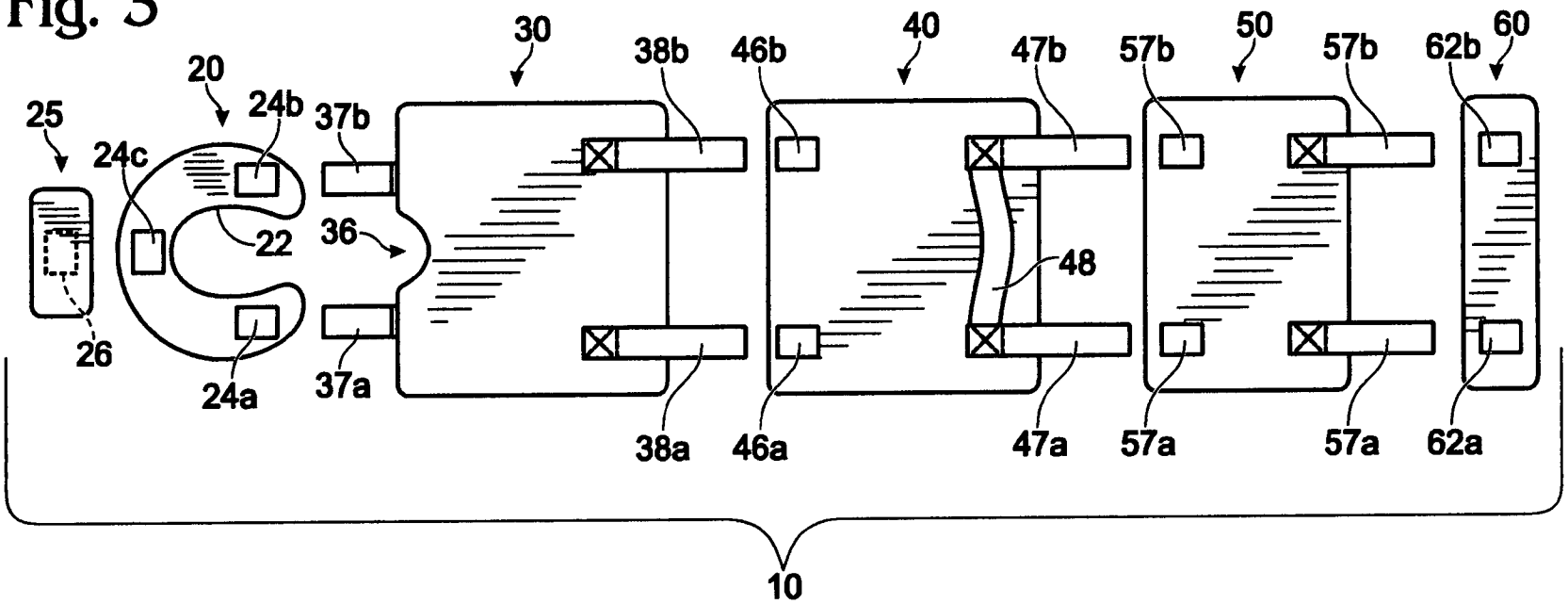
FIG. 3 is a bottom plan view of the cushion set with the various support cushions shown disconnected from one another.

FIG. 3 is a bottom plan view of the various cushions disconnected from each other in order to better show the various hook and loop fasteners and their positions.

Face support cushion 20 has hook or loop fastener components 24*a* and 24*b* located on the right and left sides thereof, and hook or loop fastener component 24*c* located on the upper end thereof, all being located on the underside of face support cushion 20.

Spacer block 25 has a loop or hook fastener component 26 located in a mid-portion of the underside thereof and adapted to releasably engage hook or loop fastener component 24*c* of face support cushion 20.

Upper torso support cushion 30 has upper right and left loop or hook fastener straps 37*a* and 37*b* extending outwardly from the upper end thereof and adapted to releasably engage right and left hook or loop fastener components 24*a* and 24*b* of face support 20, respectively. Upper torso support cushion 30 has lower right and left loop or hook fastener straps 38*a* and 38*b* whose inner ends are attached to the underside of the lower end of upper torso support cushion 30.

Lower torso support cushion 40 has right and left hook or loop fastener components 46*a* and 46*b* attached to the underside of the upper end of lower torso support cushion 40, and adapted to releasably engage right and left loop or hook fastener straps 47*a* and 47*b* of upper torso support cushion 30, respectively. Lower torso support cushion 40 has right and left loop or hook fastener straps 47*a* and 47*b* whose inner ends are attached to the underside of the lower end of lower torso support cushion 40.

Calf support cushion 50 has right and left hook or loop fastener components 56*a* and 56*b* attached to the underside of the upper end of calf support cushion 50, and adapted to releasably engage right and left loop or hook fastener straps 47*a* and 47*b* of lower torso support cushion 40. Calf support cushion 50 has right and left loop or hook fastener straps 57*a* and 57*b* whose inner ends are attached to the underside of the lower end of calf support cushion 50.

Bolster support cushion 60 has right and left hook or loop fastener components 62*a* and 62*b* attached to the underside thereof, and adapted to releasably engage right and left loop or hook fastener straps 57*a* and 57*b*, respectively.

Right hook or loop fastener components 24*a*, 46*a*, 56*a*, and 62*a*, as well as right loop or hook fastener straps 37*a*, 38*a*, 47*a*, and 57*a* all substantially lie in a common plane, i.e., are substantially in alignment with each other. Similarly, left hook or loop fastener components 24*b*, 46*b*, 56*b*, and 62*b*, as well as left loop or hook fastener straps 37*b*, 38*b*, 47*b*, and 57*b* all substantially lie in a common lane, i.e., are substantially in alignment with each other.

In use, the various support components are placed upon a support surface 12 in the order described, and right and left hook or loop fastener components are releasably engaged with adjacent right and left loop or hook fastener straps. The distance between the various support cushions can be adjusted to accommodate the location of the head, upper and lower torso of a particular user. Being fastened together, the various support components cannot slip out of place during use.

The support surface 12 can be any support surface, such as a massage table, medical examination table, floor, lounge chair, etc.

Although the cushion set 10 has been described relative to its use with the user lying face down, it can be used where the user is lying on his or her back.

Figure 4:
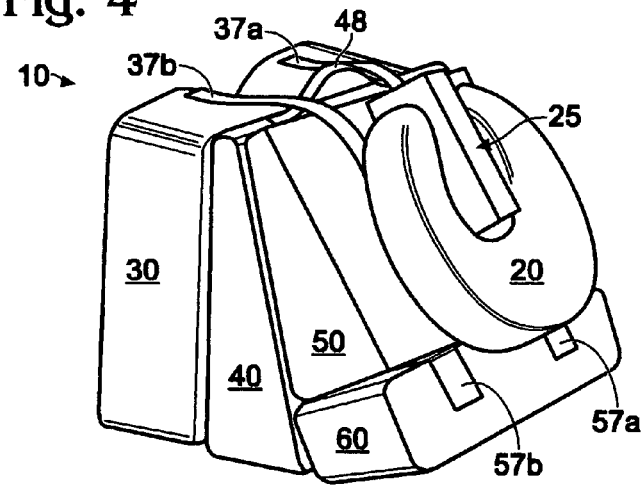
FIG. 4 is a left side perspective view of the cushion set shown in its folded-up configuration.

When not in use, cushion set 10 can be folded down into the compact and easily portable configuration shown in FIG. 4. As can be seen, the various cushions are releasably attached to each other in a manner adapted to allow the cushions to be folded up into a compact package with the upper torso support cushion 30 being in juxtaposition with the lower torso support cushion 40, the lower torso support cushion 40 being in juxtaposition with the calf support cushion 50 and the bolster support cushion 60, with the face support cushion 20 resting against calf support cushion 50. With cushion set 10 in its folded position, handle 48 is located at the top of upper torso support cushion 40 to allow the folded-up cushion set 10 to be easily carried.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A cushion set for positioning a human body comprising:

a face support cushion;

an upper torso cushion adapted to be releasably attached to said face support cushion, said upper torso cushion having an upper end, a lower end, and right and left sides, said upper torso cushion having a longitudinal axis extending between said upper and lower ends in a mid-portion thereof, said upper torso cushion being substantially rectangular in cross-section in a plane passing perpendicularly therethrough along said longitudinal axis;

a lower torso cushion adapted to be releasably attached to the lower end of said upper torso cushion, said lower torso cushion having an upper end, a lower end, and right and left sides, said upper torso cushion having a longitudinal axis extending between said upper and lower ends in a mid-portion thereof, said upper torso cushion being substantially triangular in cross-section in a plane passing perpendicularly therethrough along said longitudinal axis, the base of said triangle being the upper end of said lower torso support cushion;

a calf support cushion adapted to be releasably attached to the lower end of said lower torso cushion, said calf support cushion having an upper end, a lower end, and right and left sides, said calf support cushion having a longitudinal axis extending between said upper and lower ends in a mid-portion thereof, said calf cushion being substantially triangular in cross-section in a plane passing perpendicularly therethrough along said longitudinal axis, the base of said triangle being the lower end of said calf support cushion; and a bolster support cushion adapted to be releasably attached to the lower end said calf support cushion.

2. The cushion set of claim 1 wherein said face support cushion has an outer periphery generally in the shape of an inverted "U", said face support cushion having a generally inverted U-shaped opening passing therethrough for accommodating a user's eyes, nose and mouth when the user is lying face down on said cushion set.

3. The cushion set of claim 1 including a spacer block cushion adapted to be releasably attached to the underside of said face support cushion.

4. The cushion set of claim 1 wherein said upper torso cushion is releasably attached to said face support cushion, said lower torso cushion is releasably attached to said upper torso cushion, said calf support cushion is releasably attached to said lower torso cushion, and said bolster support cushion releasably attached to said calf support cushion all in a manner adapted to allow the space between said cushions to be adjusted.

5. The cushion set of claim 4 wherein said cushions are releasably attached to each other by hook and loop fastener means.

6. The cushion set of claim 1 wherein said cushions are releasably attached to each other in a manner adapted to allow said cushions to be folded-up into a compact package with said upper torso support cushion being in juxtaposition with said lower torso support cushion, said lower torso support cushion and said bolster support cushions being in juxtaposition with said calf support cushion, and said face support cushion resting against said calf support cushion.

7. The cushion set of claim 6 including a handle strap attached to said lower torso support cushion at a location adapted to allow the folded-up cushion set to be carried.

* * * * *